United States Patent [19]

Mills et al.

[11] Patent Number: 4,552,198

[45] Date of Patent: Nov. 12, 1985

[54] REMOVING REFRACTORY MATERIAL FROM COMPONENTS

[75] Inventors: David Mills; Alan D. Kington, both of Bristol, England

[73] Assignee: Rolls-Royce Ltd., London, England

[21] Appl. No.: 387,890

[22] PCT Filed: Oct. 2, 1981

[86] PCT No.: PCT/GB81/00216

§ 371 Date: Jun. 2, 1982

§ 102(e) Date: Jun. 2, 1982

[87] PCT Pub. No.: WO82/01144

PCT Pub. Date: Apr. 15, 1982

[30] Foreign Application Priority Data

Oct. 4, 1980 [GB] United Kingdom ..... 8032060

[51] Int. Cl.[4] ..... B22D 7/00

[52] U.S. Cl. ..... 164/122.2; 164/132

[58] Field of Search ..... 156/637, 656, 644, 616 R; 252/79.5; 164/132, 122.2; 75/101 BE; 29/156.8 H, 156.8 J

[56] References Cited

U.S. PATENT DOCUMENTS

| | | | |
|---|---|---|---|
| 3,044,087 | 7/1962 | Powers | 15/3 |
| 4,043,377 | 8/1977 | Mazdiyasni | 164/7.1 |
| 4,102,689 | 7/1978 | Borom | 106/38.9 |
| 4,134,777 | 1/1979 | Borom | 134/2 |
| 4,141,781 | 2/1979 | Greskovich et al. | 156/637 |
| 4,162,173 | 7/1979 | Arendt et al. | 134/2 |
| 4,184,885 | 1/1980 | Pasco et al. | 106/73.4 |
| 4,372,805 | 2/1983 | Takashashi | 252/79.5 |

FOREIGN PATENT DOCUMENTS

| | | |
|---|---|---|
| 926012 | 5/1963 | United Kingdom . |
| 1211824 | 11/1970 | United Kingdom . |
| 1419896 | 12/1975 | United Kingdom . |
| 2005169 | 4/1979 | United Kingdom . |
| 370281 | 11/1973 | U.S.S.R. . |

OTHER PUBLICATIONS

"Investment Casting by Centrax-Misco Limited", Tooling, Jul. 1965, No. 7, 19–20, 22–26.

Chemical Technology of Ceramics and Refractory Materials, ed. by P. P. Budnikov et al., Moscow, Stroitel'stvo Publishers, 1972, pp. 126–128, 312, 317–318 with English translation.

I. D. Abramson, "Ceramics of Aircraft Devices", Moscow, Oborongiz Publishers, 1963, pp. 162–163 with English translation.

*Primary Examiner*—Hiram H. Bernstein

*Attorney, Agent, or Firm*—Parkhurst & Oliff

[57] ABSTRACT

A method of removing refractory material from a component comprises contacting the refractory material with a chemically active agent whereby to convert the refractory material to a more easily removable substance, and removing the more easily removable substance. The method enables alumina cores defining cooling passages in cast blades for use in gas turbine engines to be removed at practically useful rates.

19 Claims, No Drawings

REMOVING REFRACTORY MATERIAL FROM COMPONENTS

This invention relates to the removal of refractory material from components. The invention finds particular application in removing refractory cores from cast components such as blades for use in gas turbine engines, the cores defining, for example, openings such as cavities or passages required for cooling purposes.

Typically in the casting of such blades, a core defining the cooling passages is inserted into a mold, molten blade material is introduced into the mold, the blade is solidified and the core is removed from within the blade.

Fused silica is most commonly used as the core material because of its good chemical removability. However, considerable problems occur with this material due to bowing and distortion of the core, which problems are due to the relatively poor refractory properties of the material. In particular, directional solidification techniques (which are necessary or desirable in many applications to produce high strength, long life blades) may impose excessively severe conditions for fused silica to be used as the core material. Hence, in such applications the use of fused silica as the core material precludes the use of directional solidification techniques and results in blades being relatively weak and having a relatively short life.

It has long been recognised that other materials might be used as core materials and considerable effort has been expanded in looking for materials, other than fused silica, of high strength and high refractoriness which can be easily removed. High temperature fired, recrystallised alumina has the required properties of high strength and high refractoriness but, until this invention, such alumina has been considered generally unsuitable as a core material because of the difficulty of removing the material at practically useful rates. Indeed, much effort has gone into devising structural forms of alumina which present an increased surface area to a dissolving agent and so dissolve more quickly. An example of such a structural form of fired alumina is disclosed in U.S. Pat. No. 4,184,885.

The inventors have made the surprising discovery that high-temperature fired, re-crystallised alumina can, in fact, be readily removed from components at a practically useful rate. The method of the invention has also been found to be applicable to removing other refractory material such as magnesia, steatite and spinel, which were previously thought to be generally unsuitable as core materials because of the difficulties of removing the materials at pratically useful rates. It is believed that the method of the invention may also be applicable to the removing of other refractory materials which were previously considered unsuitable as blade core materials and which have not yet been tried in the present invention.

According to a first aspect of the invention, a method of removing refractory material from a component comprises contacting the material with a reduced concentration aqueous solution of dissolving agent at an elevated temperature and an elevated pressure.

The present invention is thus distinguished from previous attempts to remove refractory oxide materials such as alumina from components since, whereas these previous attempts have sought to dissolve the material directly, the present invention first reacts a chemically reactive agent with the refractory material to convert it to a substance which is more easily removable and then removes this substance.

According to a second aspect of the invention, a method of casting a component having an opening therein comprises the steps of:

- inserting into a mold refractory material defining the opening;
- introducing into the mold molten component material;
- solidifying the component and dissolving the refractory material by a method according to the first aspect of the invention.

One method of casting blades having internal cooling passages for use in a gas turbine engine will now be described, by way of example only.

Into a blade mold of known type is inserted a core of pure substantially 100% dense recrystallised alumina. The alumina is of tubular, preferably extruded, form and is shaped to define the cooling passages required in the blade to be cast in the mold. In its simplest form the core may comprise one or more straight tubular strips of alumina, but the exact arrangement and shape will depend on the particular cooling requirements of the blade to be cast.

Molten blade material of the desired type, e.g. an alloy sold by INCO Ltd., under the trade name IN100, is then introduced into the mold. The blade is then allowed to solidify. In order to avoid imperfections in the structure of the blade and so to improve the strength of the blade, the solidification of the blade may be directionally controlled. Such directional solidification techniques are well known in the art and will not be further described herein.

When the solidification is complete, the cast blade is removed from the mold and the alumina core is removed from within the blade by immersing the blade containing the core in an aqueous solution made up of potassium hydroxide (approximately 90% W/V) and water (approxiamtely 10% W/V) at a temperature of approximately 350° C. and at atmospheric pressure.

With this method it has been found possible to remove from blades of IN100 material, in approximately seventeen hours, tubed cores of pure, substantially 100% dense recrystallised alumina of some seven inches long, with external diameter approximately 0.08 inches and internal diameter approximately 0.04 inches.

In the method, it is thought that nascent hydrogen is generated, at the temperature used, from the hydrogen provided in the solution by the water. This nascent hydrogen is highly reactive and is thought to react with the largely inert aluminum to reduce it to aluminium hydroxide. The aluminum hydroxide then dissolves in the potassium hydroxide in the solution. It has been found that the temperature used in the method is not critical, decreased temperature resulting in slower alumina removal and increased temperature resulting in quicker alumina removal, but that if too great a temperature is used considerable chemical attack on the blade by the nascent hydrogen can occur.

Other methods of removing similar size tubular cores of recrystallised alumina from blades cast in IN100 material which also proved successful are described hereafter.

Alumina cored blades of IN100 material immersed in a solution of sodium hydroxide (approximately 80% W/V) and water (approximately 20% W/V) at a temperature of approximately 220° C. and at atmospheric pressure were successfully de-cored in approximately 20 hours.

Alumina cored blades of IN100 material immersed in a solution of potassium hydroxide (approximately 65% W/V) and water (approximately 35% W/V) at a temperature of approximately 200° C. and at atmospheric pressure were successfully de-cored in approximately 20 hours.

Alumina cored blades of IN100 material immersed in a solution of potassium hydroxide (approximately 65% W/V) and water (approximately 35% W/V) at a temperature of approximately 370° C. and at a pressure of approximately 3 atmospheres were successfully de-cored in approximately 17 hours. It will be appreciated that the increased pressure allows an increased temperature to be used without the solution boiling away. Such a method of removing alumina cores is conveniently carried out in an autoclave.

Alumina cored blades of IN100 material immersed in a solution of potassium hydroxide (approximately 60% W/V) and water (approximately 40% W/V) at a temperature of approximately 350° C. and a pressure of approximately 100 atmospheres were successfully de-cored in approximately 20 hours. Such a method of removing alumina cores is conveniently carried out in an autoclave.

Alumina cored blades of IN100 material immersed in a solution of sodium hydroxide (approximately 20% W/V) and water (approximately 80% W/V) at a pressure of approximately 5 atmospheres and at a temperature repeatedly increased from approximately 150° C. to 157° C. i.e. from just below to just above the boiling point of the solution, to boil the solution repeatedly were successfully de-cored in approximately 20 hours. It will be understood that in this method physical activity in the solution due to boiling improves removal of the core while maintaining substantially the same composition of the solution. Such a method of removing alumina cores is also conveniently carried out in an autoclave.

Alumina cored blades of IN100 material immersed in a solution of potassium hydroxide (approximately 65% W/V), lithium hydroxide (approximately 15% W/V) and water (approxiamtely 20% W/V) at a temperature of approximately 350° C. and at atmospheric pressure were successfully de-cored in approximately 17 hours.

Similar favorable results have been obtained, using the above methods of removal, in removing from blades of IN100 material cores of high-temperature fired magnesia, steatite, spinel and unillite, these materials having previously been considered unsuitable as blade core materials.

It is believed that the invention may also be applicable to the removal from components of other refractory materials which were previously considered unsuitable as blade core materials and which have not yet been tried in the present invention.

It will be appreciated that although in the above-described examples of methods of removing recrystallised alumina cores from blades nascent hydrogen is believed to be generated from water, other hydrogen containing compounds may alternatively be used, e.g. sodium hydride or potassium hydride.

It will also be appreciated that the inventive principle demonstrated in the above examples of chemically converting the refractory material to a more easily removable substance and subsequently removing this substance may alternatively be employed utilizing other chemically reactive converting agents and methods of removal.

We claim:

1. A method of casting a component having an opening therein comprising the steps of:

inserting into a mold a refractory material of high temperature fired re-crystallized substantially 100% dense pure metal oxides defining the opening;

introducing into the mold molten component material;

solidifying the component; and removing the refractory material by chemically reacting it with nascent hydrogen produced by immersing the casting in an aqueous solution of a hydroxide or hydride of a metal selected from sodium, potassium and lithium and containing substantially 10–35% W/V of water and leaching the resultant products; all the while heating the solution to a temperature in the range of 150°–370° C.

2. A method according to claim 1 wherein the component is a blade for use in a gas turbine engine.

3. A method of removing a casting core of high-temperature fired re-crystallized substantially 100% dense pure metal oxides from a metal casting, comprising the steps of:

chemically reacting the core with nascent hydrogen produced by immersing the casting containing the core in an aqueous solution of a hydroxide or hydride of a metal selected from sodium, potassium and lithium and containing substantially 10–35% W/V of water and leaching the resultant products; all the while heating the solution to a temperature in the range of 150°–370° C.

4. A method according to claim 3 wherein the method is carried out at a temperature in the range from substantially 200° C. to substantially 350° C. and at a pressure of substantially 1 atmosphere.

5. A method according to claim 3 wherein the solution comprises substantially 90% W/V potassium hydroxide and substantially 10% W/V water, the temperature is substantially 350° C. and the pressure is substantially atmospheric.

6. A method according to claim 3 wherein the solution contains substantially 65% W/V potassium hydroxide, substantially 15% W/V lithium hydroxide and substantially 20% W/V water, the temperature is substantially 350° C. and the pressure is substantially atmospheric.

7. A method according to claim 3 wherein the solution contains substantially 80% W/V sodium hydroxide and substantially 20% W/V water, the temperature is substantially 220° C. and the pressure is substantially atmospheric.

8. A method according to claim 3 wherein the solution contains substantially 65% W/V potassium hydroxide and substantially 35% W/V water, the temperature is substantially 200° C. and the pressure is substantially atmospheric.

9. A method according to claim 3 wherein the solution contains substantially 65% W/V potassium hydroxide and substantially 35% W/V water, the temperature is substantially 370° C. and the pressure is substantially 3 atmospheres.

10. A method according to claim 3 wherein the solution contains substantially 60% W/V potassium hydroxide and substantially 40% W/V water, the temperature is substantially 350° C. and the pressure is substantially 100 atmospheres.

11. A method according to claim 3 wherein the solution contains substantially 80% W/V sodium hydroxide and substantially 20% W/V water, the pressure is substantially 5 atmosphere and the temperature is repeatedly increased from substantially 150° C. to substantially 157° C. to boil the solution repeatedly.

12. A method according to claim 3 wherein the refractory material is of tubular form.

13. A method according to claim 3 wherein the refractory material is alumina.

14. A method according to claim 3 wherein the refractory material is magnesia.

15. A method according to claim 3 wherein the refractory material is steatite.

16. A method according to claim 3 wherein the metal oxide is spinel.

17. A method according to claim 1 wherein the step of solidifying the component comprises directionally solidifying the component.

18. A method according to claim 3 wherein the component is a blade for use in a gas turbine engine.

19. A method according to claim 3 wherein the solution is heated in an autoclave.

* * * * *